US009214723B2

(12) United States Patent
Lan et al.

(10) Patent No.: US 9,214,723 B2
(45) Date of Patent: Dec. 15, 2015

(54) WATERPROOF PART

(71) Applicant: Wistron NeWeb Corporation, Hsinchu (TW)

(72) Inventors: I-Ching Lan, Hsinchu (TW); Chung-Min Lai, Hsinchu (TW); Tzong-Jyh Chen, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 171 days.

(21) Appl. No.: 14/194,822

(22) Filed: Mar. 3, 2014

(65) Prior Publication Data

US 2015/0188219 A1 Jul. 2, 2015

(30) Foreign Application Priority Data

Dec. 26, 2013 (TW) ..... 102148476 A

(51) Int. Cl.
*H01Q 13/02* (2006.01)
*H01Q 1/40* (2006.01)

(52) U.S. Cl.
CPC ..... *H01Q 1/40* (2013.01); *H01Q 13/0208* (2013.01)

(58) Field of Classification Search
CPC ..... H01Q 19/08; H01Q 13/02; H01Q 1/42; H01Q 19/132; H01Q 1/288
USPC ..... 343/784, 786, 832, 840, 838
See application file for complete search history.

(56) References Cited

U.S. PATENT DOCUMENTS 5,963,171 A * 10/1999 Jones ..... H01Q 1/02 343/704
7,202,834 B2 * 4/2007 Nagano ..... H01Q 1/247 343/772
7,474,271 B2 * 1/2009 Nagano ..... H01Q 13/0266 343/786
8,354,970 B2 * 1/2013 Armbrecht ..... H01Q 1/225 343/772
8,797,207 B2 * 8/2014 Kienzle ..... B29C 45/2624 342/124
2004/0227686 A1 * 11/2004 Sasaki ..... H01Q 13/02 343/786
2006/0125705 A1 * 6/2006 Nagano ..... H01Q 1/421 343/786
2007/0109193 A1 * 5/2007 Biddulph ..... H01Q 9/0421 343/700 MS
2009/0058749 A1 * 3/2009 Shimoi ..... H01Q 1/42 343/786

* cited by examiner

*Primary Examiner* — Linh Nguyen
(74) *Attorney, Agent, or Firm* — Winston Hsu; Scott Margo

(57) ABSTRACT

A waterproof part for a feedhorn includes a first waterproof unit having a first interface for generating a first reflected wave and a first transmitted wave when a satellite signal incidents the first interface, and a second waterproof unit covering on the first waterproof unit and having a second interface for generating a second reflected wave and a second transmitted wave when the first transmitted wave incidents the second interface, wherein the first and second reflected waves are substantially out-of-phase to substantially cancel the first and second reflected waves.

10 Claims, 8 Drawing Sheets

WATERPROOF PART

BACKGROUND OF THE INVENTION

1. Field of the Invention

The present invention relates to a waterproof part for a feedhorn, and more particularly, to a waterproof part having double waterproof units for a feedhorn to ensure return loss and useful bandwidth.

2. Description of the Prior Art

A feedhorn, which is also known as low-noise block converter, for a satellite antenna is disposed on a focus of a dish reflector of the satellite antenna. The feedhorn is used for receiving radio signals reflected via the dish reflector from a satellite or transmitting radio signals to the satellite. The satellite antenna is usually installed at an outdoor location such as a roof or an exterior wall of a building to ensure communication quality against signal blocking.

The feedhorn is normally equipped with a waterproof part made of insulation materials to prevent rain water from dripping into the feedhorn. During signal transmission, the satellite signals encounter insertion loss and part of the satellite signals are attenuated when the satellite signals pass through the waterproof part. Another part of the satellite signals transmit through the waterproof part to be reflected by the dish reflector to the air. However, due to dielectric constants and impedance differences between the waterproof part and the air, there is a reflected wave generated at an incident interface of the waterproof part, which is reflected backward to the feedhorn. In such a situation, a radiating efficiency of the feedhorn is decreased, and a useful bandwidth of the feedhorn may become narrower.

In addition, a return loss of the satellite signal or the feedhorn (i.e. a ratio of incident and reflected waves) is relative to the radiating efficiency and the useful bandwidth. Under some conditions, the waterproof part may improve the return loss but narrows the useful bandwidth, and thus the return loss and the useful bandwidth cannot be improved at the same time. Therefore, how to improve both of the return loss and the useful bandwidth of the satellite signals or the feedhorn has become a topic of the industry.

SUMMARY OF THE INVENTION

It is therefore an objective of the present invention to provide a double-layered waterproof part to ensure the return loss and the useful bandwidth of the feedhorn.

An embodiment of the present invention discloses a waterproof part for a feedhorn. The waterproof part includes a first waterproof unit having a first interface for generating a first reflected wave and a first transmitted wave when a satellite signal incidents the first interface, and a second waterproof unit covering on the first waterproof unit and having a second interface for generating a second reflected wave and a second transmitted wave when the first transmitted wave incidents the second interface, wherein, the first and second reflected waves are substantially out-of-phase to substantially cancel the first and second reflected waves.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
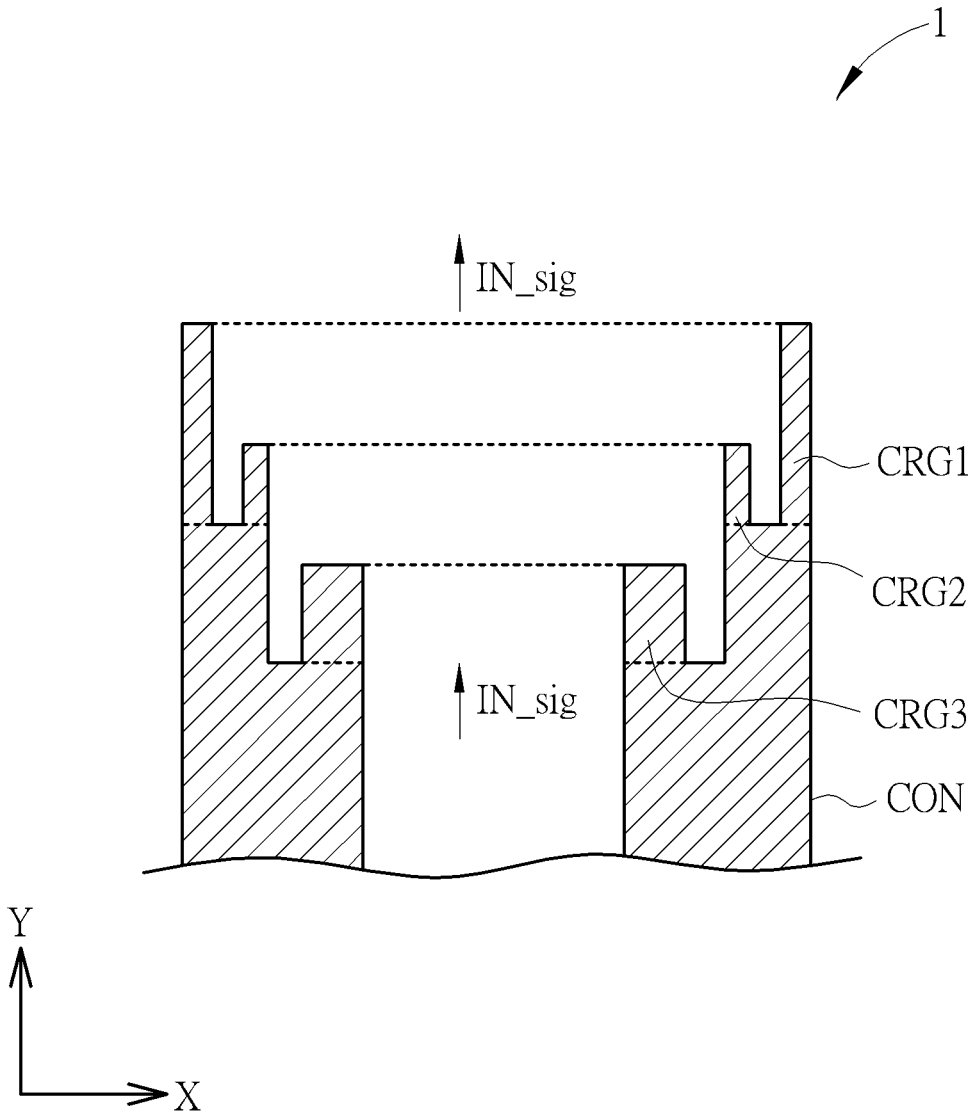
FIG. 1 is a schematic diagram of a feedhorn.
Figure 2:
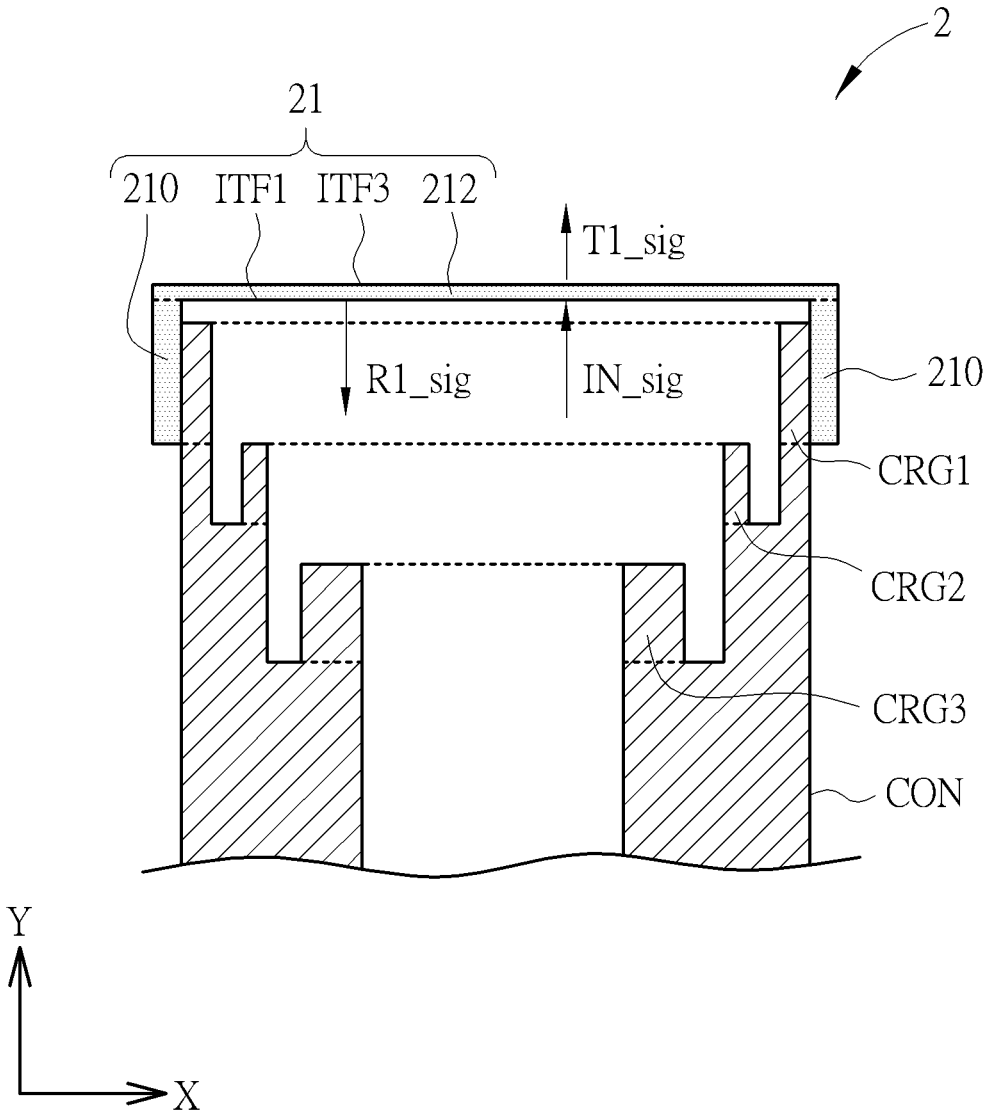
FIG. 2 is a schematic diagram of a feedhorn equipped with a single-layered waterproof part.

Please refer to FIG. 1 and FIG. 2. FIG. 1 is a schematic diagram of a feedhorn 1, and FIG. 2 is a schematic diagram of a feedhorn 2 equipped with a single-layered waterproof part 21. Both of the feedhorn 1 and 2 has an identical conical body CON with a same shape and made of a same material, the conical body CON is used for transmitting the satellite signal IN_sig to a reflection dish of a satellite antenna. There are a number of corrugations CRG1, CRG2 and CRG3 formed on the conical body CON, e.g. three corrugations, which is not limited. In FIG. 1, there is only air existing in a signal path of the satellite signal IN_sig when transmitted by the feedhorn 1. In comparison, the feedhorn 2 shown in FIG. 2 is equipped with a waterproof unit 21, for such a structure, there are different mediums (i.e. the air and the waterproof unit 21) existing in the signal path of the satellite signal IN_sig when transmitted by the feedhorn 2. Therefore, the satellite signal IN_sig encounters discontinuous impedances to cause part of the satellite signal IN_sig is reflected backward to the feedhorn 2.

The corrugation CRG1 is covered with the waterproof unit 21. The waterproof unit 21 includes a sidewall 210 and a plate 212 including interfaces ITF1 and ITF3. The interface ITF1 extends along the direction X and is located between the conical body CON and the plate 212, wherein the interface ITF1 is regarded as an incident interface that the satellite signal IN_sig enters before entering the plate 212 and after passing through the conical body CON. The interface ITF3 extends along the direction X, and is regarded as a transmitted interface that the satellite signal IN_sig encounters after passing through the plate 212. The sidewall 210 is coupled to the plate 212 and extends along a direction Y, and the corrugation CRG1 is surrounded by the sidewall 210, such that the corrugation CRG1 is covered with the waterproof unit 21. Specifically, the interface ITF1 reflects part of the satellite signal IN_sig to generate a reflected wave R1_sig when the satellite signal IN_sig incidents the interface ITF1. While the rest of the satellite signal IN_sig incidents the waterproof unit 21 to generate a transmitted wave T1_sig at the interface ITF3 of the waterproof unit 21.

Figure 4:
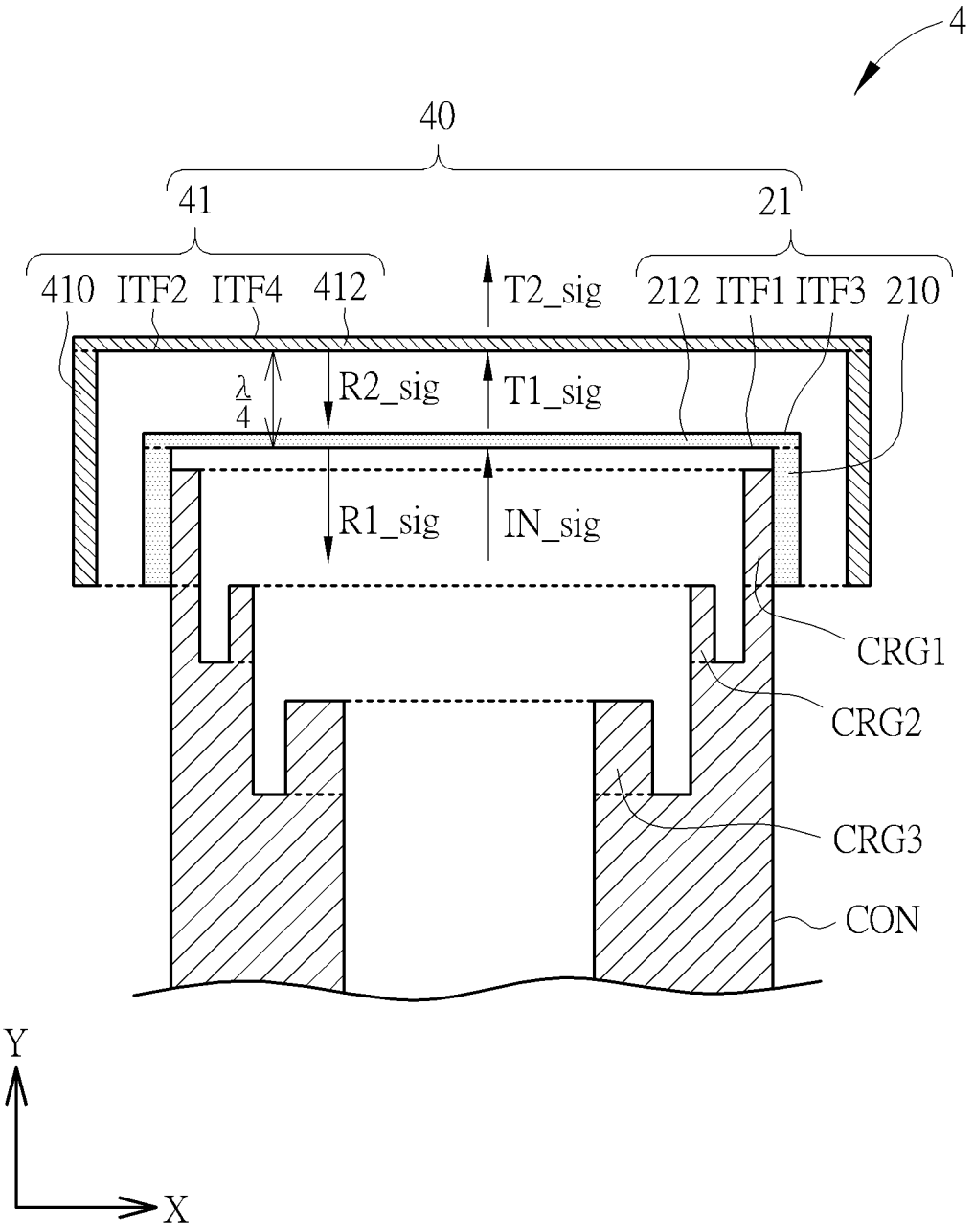
FIG. 4 is a schematic diagram of a feedhorn according to an embodiment of the present invention.

For structural considerations, a shape of the waterproof unit 21 is corresponding to an opening mouth of the conical body CON or the corrugation CRG1. The present embodiment assumes an opening of the conical body CON or the corrugation CRG1 is a circle, thereby the interfaces ITF1 and ITF3 are also circles, and the sidewall 210 is coupled to peripheries of the interfaces ITF1 and ITF3. On the other hand, as shown in FIG. 4, interfaces ITF2 and ITF4 are circles, and a sidewall 410 is coupled to peripheries of the interfaces ITF2 and ITF4. Please note that the shape to the interface has no limitations and can be modified according to practical requirements.

Figure 3:
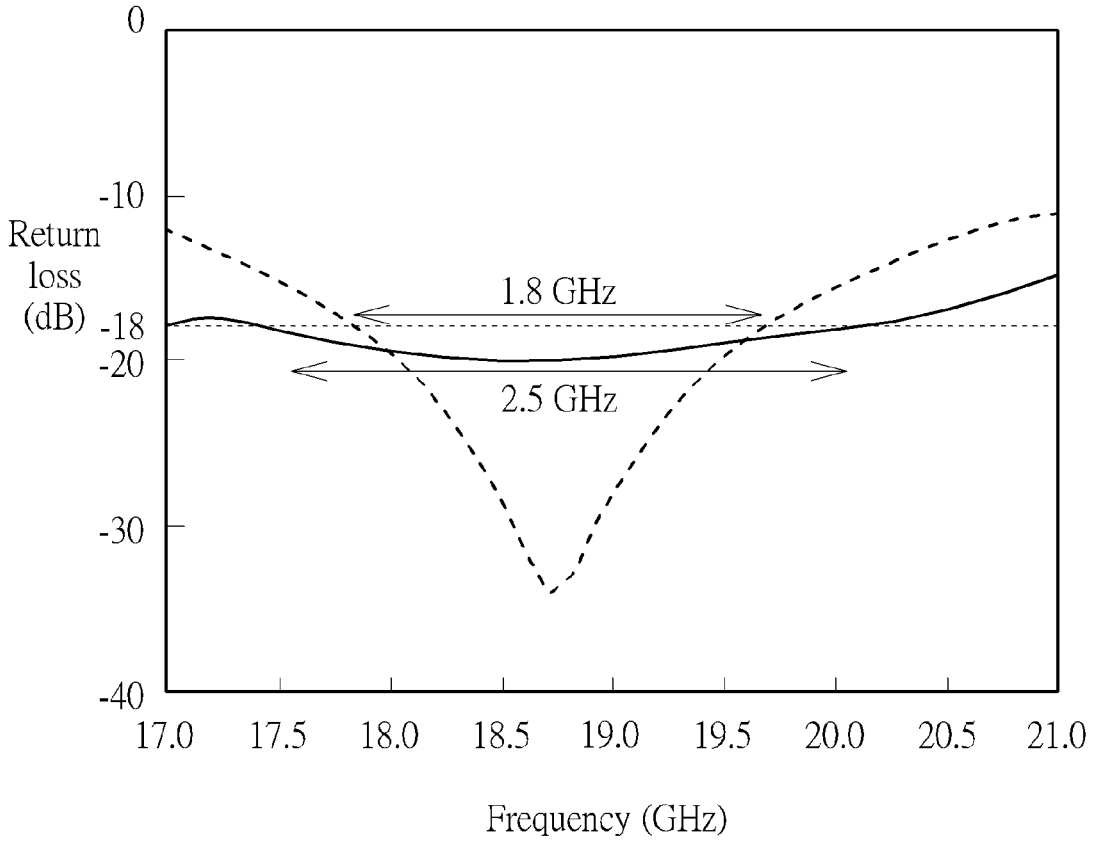
FIG. 3 is a comparison chart of return losses between the feedhorns shown in FIG. 1 and FIG. 2.

Please refer to FIG. 3, which is a comparison chart of return losses between the feedhorns 1 and 2. The return loss of the feedhorn 1 is denoted with a solid line, and the return loss of the feedhorn 2 is denoted with a dashed line. In FIG. 3, a useful bandwidth, in which the return loss is lower than −18 dB, of the feedhorn 1 substantially ranges from 17.5 GHz to 20 GHz (i.e. the bandwidth is 2.5 GHz), and a useful bandwidth of the feedhorn 2 substantially ranges from 17.8 GHz to 19.6 GHz (i.e. the bandwidth is 1.8 GHz).

Due to a structural discontinuous of the feedhorn 1, the satellite signal IN_sig is slightly reflected despite that there is only air existing in the signal path of the satellite signal IN_sig when passing through the feedhorn 1. As can be seen from FIG. 3, the return loss of the feedhorn 1 within the useful bandwidth shows limited and smooth results, and the useful bandwidth is 2.5 GHz wider than the useful bandwidth 1.8 GHz of the feedhorn 2. On the other hand, return loss of the feedhorn 2 equipped with the waterproof unit 21 shows a notch shape and the useful bandwidth is narrower. Therefore, although part of the return loss of the feedhorn 2 is improved due to the waterproof unit 21 but narrows the useful bandwidth by 0.7 GHz, which reduces an application range of the feedhorn 2. Hence, under the structures of the feedhorns 1 and 2, the return loss and the useful bandwidth cannot be improved at the same time.

Therefore, the present invention provides a feedhorn with double-layered waterproof unit to improve both of the return loss and the useful bandwidth at the same time. Please refer to FIG. 4, which is a schematic diagram of a feedhorn 4 according to an embodiment of the present invention. The feedhorn 4 includes a waterproof part 40 and the conical body CON which is identical with that of the feedhorns 1 and 2. The waterproof part 40 includes the waterproof units 21 and 41. The waterproof unit 21 is covered with the waterproof unit 41. The waterproof unit 41 includes a sidewall 410 and a plate 412. The plate 412 includes the interfaces ITF2 and ITF4. The interface ITF2 extends along the direction X, and is located between the interface ITF3 and the plate 412, wherein the interface ITF2 is regarded as an incident interface that the transmitted wave T1_sig encounters before entering the plate 412. The interface ITF4 extends along the direction X, and is regarded as a transmitted interface that the transmitted wave T1_sig encounters after passing through the plate 412. The sidewall 410 is coupled to the plate 412, and extends along the direction Y. The sidewall 210 is surrounded by the plate 412, such that the waterproof unit 21 is covered with the waterproof unit 41. Specifically, when the transmitted wave T1_sig incidents the interface ITF2 of the waterproof unit 41, the interface ITF2 reflects part of the transmitted wave T1_sig to generate a reflected wave R2_sig. While another part of the transmitted wave T1_sig transmits through the waterproof unit 41 to generate a transmitted wave T2_sig at the opposite interface ITF4 of the waterproof unit 41. According to an embodiment of the invention, a distance between the interfaces ITF1 and ITF2 is substantially a quarter wavelengths ($\lambda/4$) of a central frequency of the satellite signal IN_sig, such that reflected waves R1_sig and R2_sig are substantially out-of-phase to substantially cancel the reflected waves R1_sig and R2_sig, thereby improves a return loss of feedhorn 4. The direction X is perpendicular to the direction Y.

Figure 5:
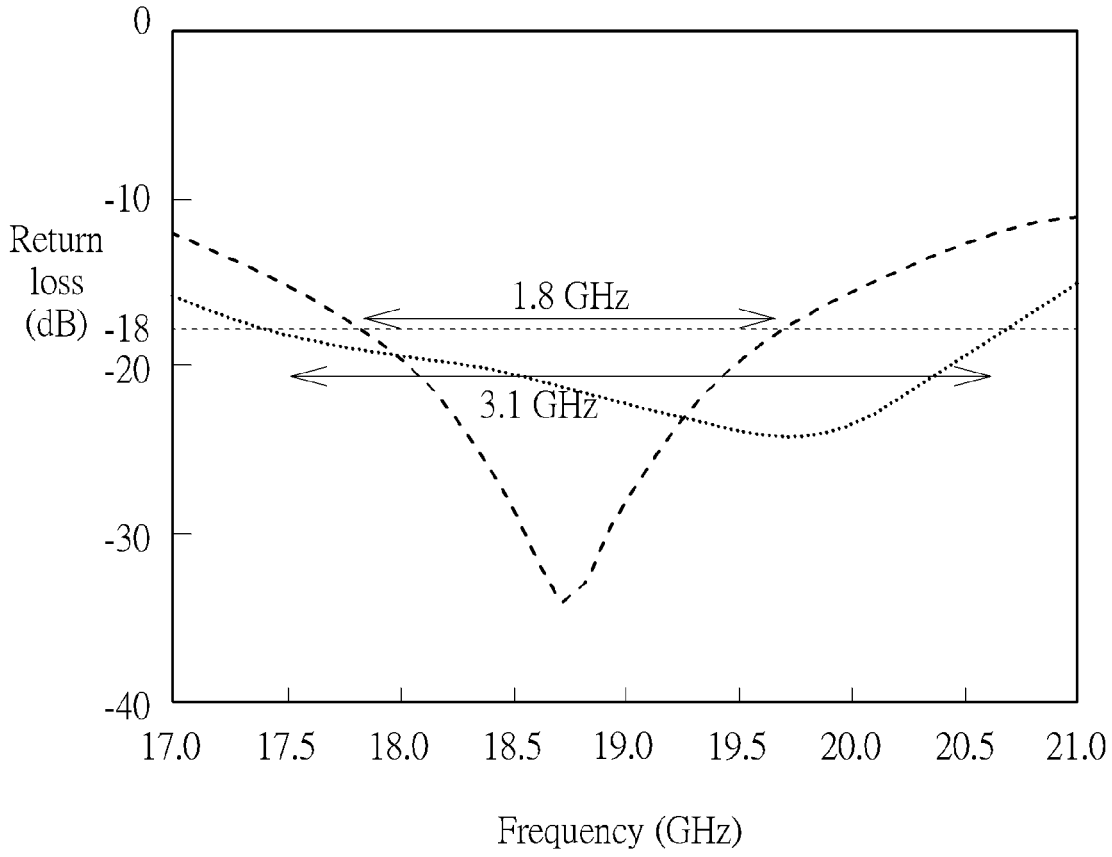
FIG. 5 is a comparison chart of the return losses of the feedhorns shown in FIG. 2 and FIG. 4.

Please refer to FIG. 5, which is a comparison chart of the return losses of the feedhorns 2 and 4. The return loss of the feedhorn 4 is denoted with a dotted line, and the return loss of the feedhorn 2 is denoted with a dashed line. As shown in FIG. 5, a useful bandwidth, whose return loss is lower than −18 dB, of the feedhorn 4 substantially ranges from 17.5 GHz to 20.6 GHz to have a bandwidth of 3.1 GHz. Compare FIG. 3 with FIG. 5, the return loss of the feedhorn 4 is lower than the return loss of the feedhorn 1 without the waterproof unit, and the useful bandwidth of the feedhorn 4 is wider than the useful bandwidths of the feedhorns 1 and 2. As can be seen, consider a situation that the shape and material of the conical body are fixed, the feedhorn 4 with the double-layered waterproof unit has the lower and the widest useful bandwidth among the feedhorns 1, 2 and 4, such that an application range of the feedhorn 4 is wider than the others. Therefore, both of the return loss and the useful bandwidth of the feedhorn 4 are improved.

In short, the feedhorn 4 of the present invention is equipped with the waterproof units 21 and 41 (i.e. double-layered waterproof part), such that the reflected waves R1_sig and R2_sig of the waterproof units 21 and 41 are substantially out-of-phase to substantially cancel the reflected waves R1_sig and R2_sig. Under the condition that the shape and material of the conical body are fixed, the return loss and the useful bandwidth of the feedhorn 4 may be improved at the same time. Those skilled in the art may make modifications or alterations accordingly, which is not limited. For example, a number of waterproof units disposed on the feedhorn or the conical body is not limited. Or, a designer may adjust the distance between the interfaces ITF1 and ITF2 according to different operating frequencies, which is not limited to the central frequency of the satellite signal IN_sig.

In addition, locations where the waterproof units are disposed on the conical body are not limited. In the embodiment of FIG. 4, the corrugation CRG1 of the conical body is covered with the waterproof unit 21, and the waterproof unit 21 is covered with the waterproof unit 41. Please refer to FIG. 6, which is a schematic diagram of a feedhorn 6 according to another embodiment of the present invention. A waterproof part 60 of the feedhorn 6 includes waterproof units 21 and 61, wherein the corrugation CRG2 of the conical body is covered with the waterproof unit 61. A difference between the waterproof parts 60 and 40 is that locations where the waterproof units 41 and 61 are disposed are different, such that volumes of the feedhorns 6 and 4 are different. Specifically, the waterproof unit 41 of the waterproof part 40 is located outside of the conical body, which increases the volume of the feedhorn 4; while the waterproof unit 61 of the waterproof part 60 is located inside the conical body, which does not increase volume of the feedhorn 6, and the volume of the feedhorn 6 is smaller than the volume of the feedhorn 4.

Figure 6:
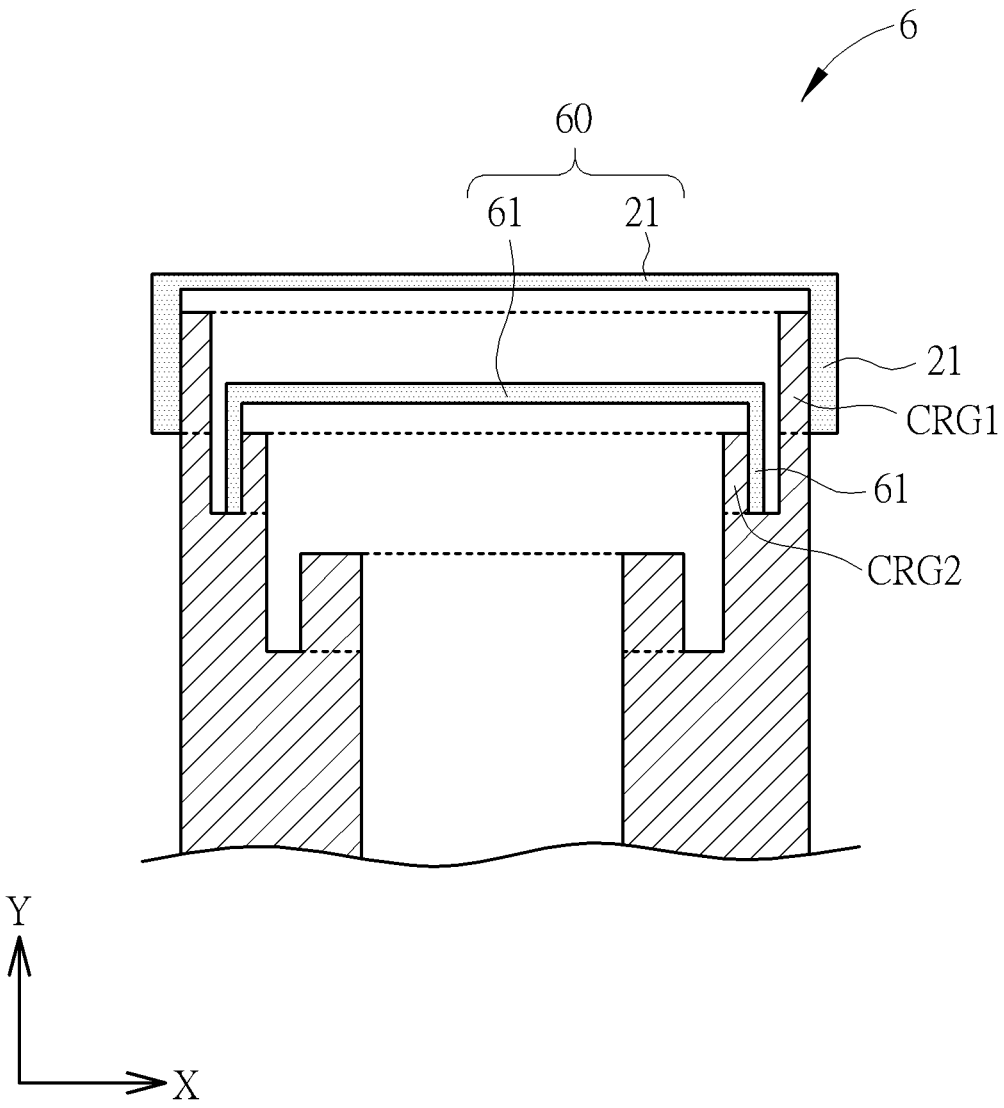
FIG. 6 is a schematic diagram of a feedhorn according to another embodiment of the present invention.
Figure 7:
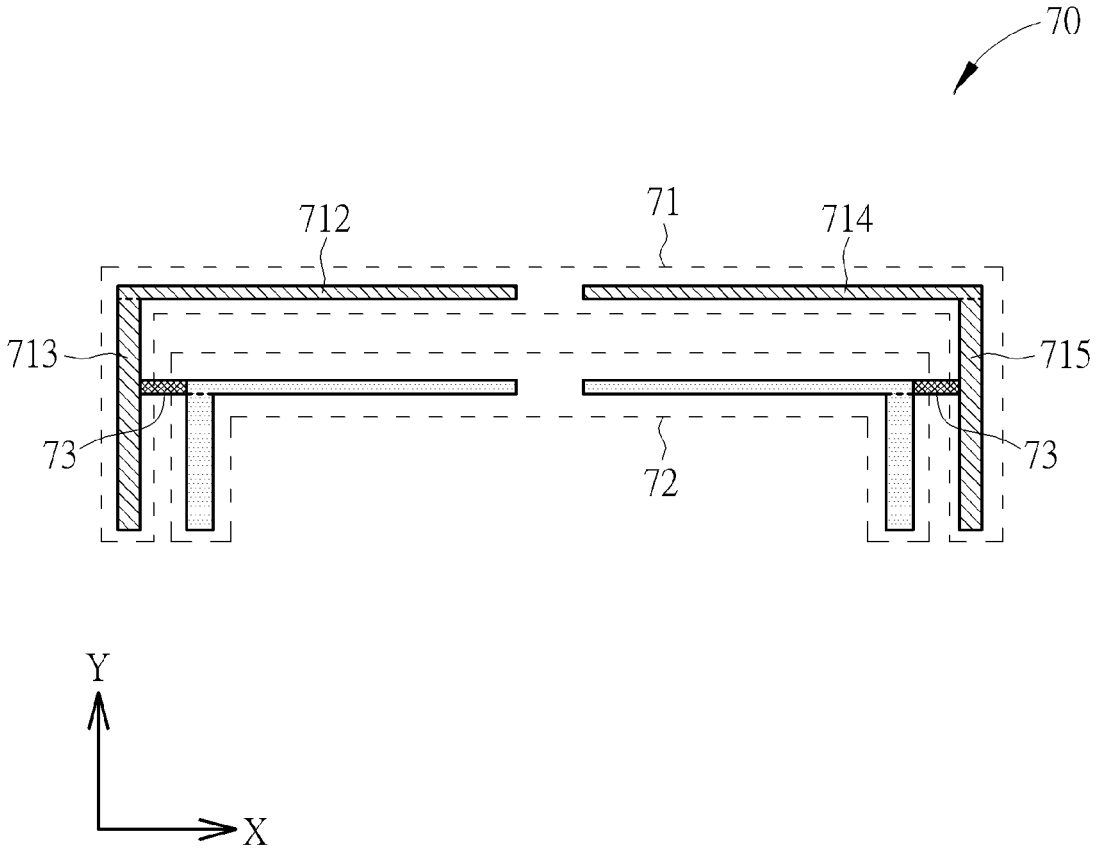
FIG. 7 and FIG. 8 illustrate a side view and an isometric view of a waterproof part according to another embodiment of the present invention, respectively.
Figure 8:
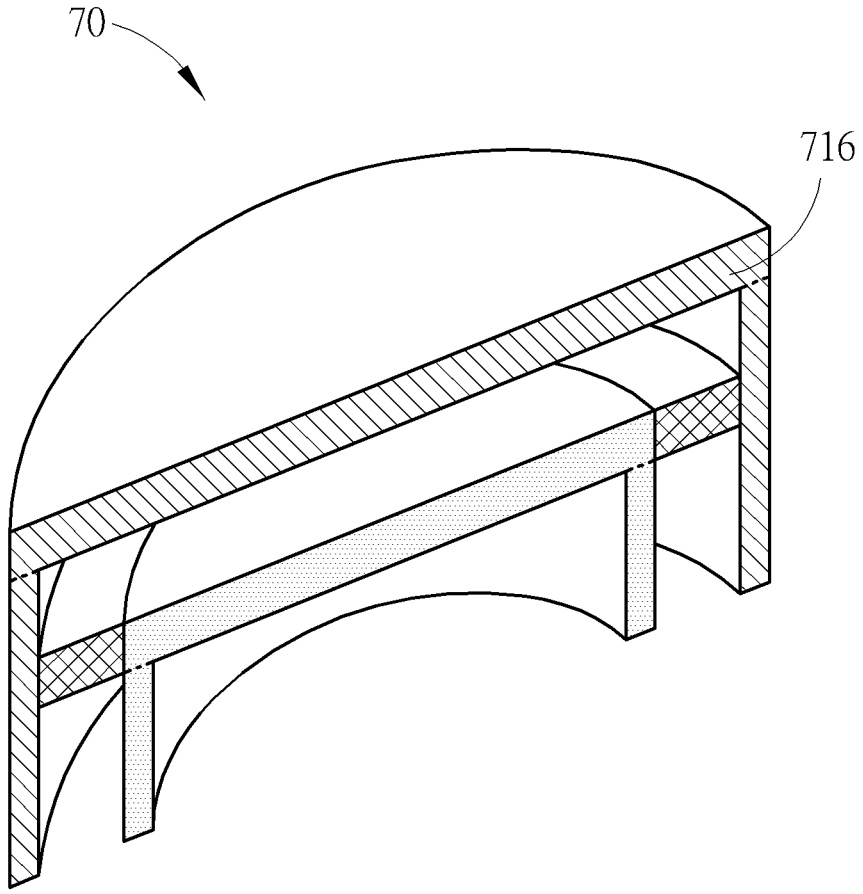

On the other hand, a forming structure of the double-layered waterproof part and an assembly process corresponding to the forming structure are not limited. In the embodiments of FIG. 4 and FIG. 6, the waterproof units 21, 41 and 61 are single units, however, the waterproof unit 21, 41 or 61 may be assembled by multiple sub-units. For example, please refer to FIG. 7 and FIG. 8, which illustrate a side view and an isometric view of a waterproof part 70 according to another embodiment of the present invention, respectively. The waterproof part 70 includes waterproof units 71, 72 and a bonding unit 73. Noticeably, the waterproof units 71 and 72 are assembled by multiple sub-units. Take the waterproof unit 71 for example, the waterproof unit 71 includes sub-plates 712 and 714, sub-sidewalls 713 and 715 and a bonding interface 716. The sub-plate 712 is coupled to the sub-sidewall 713 to form a sub-unit having an inverted-L shape; the sub-plate 714 is coupled to the sub-sidewall 715 to from another sub-unit having the inverted-L shape. The sub-plates 712 and 714 and the sub-sidewalls 713 and 715 may be bonded together at the bonding interface 716, which is denoted with a slash pattern, to assemble into a complete waterproof unit, i.e. the waterproof unit 41. Similarly, the waterproof unit 72 includes two sub-plates, two sub-sidewalls and a bonding interface, such that the sub-plates and sub-sidewalls of the waterproof unit 72 may be bonded at the bonding interface, which is denoted with a dot pattern shown in FIG. 8 to assemble a complete waterproof unit, i.e. the waterproof unit 21. The bonding unit 73 is used for bonding the waterproof unit 71 and 72. It is assumed that the complete plate shown in FIG. 7 and FIG. 8 are circle, which is not limited, and a shape of the complete plate can be varied according to practical requirements. Also, a shape of the sidewall can be modified without limitations.

The waterproof units 21 and 41 shown in FIG. 4 are single parts, and having an inverted-U shape, while the waterproof units 71 and 72 shown in FIG. 7 are assembled by multiple sub-units, and each of the sub-units has the inverted-L shape. If two sub-units having the inverted-L shape are bonding together at the bonding interface, a double-layered waterproof part having the inverted-U shape may be formed, i.e. a combination of the waterproof parts 20 and 40 and a combination of the waterproof units 21 and 41. In short, differences between the waterproof parts 70 and 40 are the forming structure and the assembling process corresponding to the forming structure, and both of the waterproof parts 70 and 40 are capable of improving the return loss and the useful bandwidth at the same time.

Please note that the waterproof units 71 and 72 may be designed with bonding structures, not shown in FIG. 7, at the bonding interface for enhancing an ability of waterproof. Take the waterproof unit 71 for example, one of two sub-units of the waterproof unit 71 may be formed by a mold modified from a mold of the other sub-unit, which is beneficial for cost control since modifying a mold on hand is cheaper than making a new mold. When assembling, an operator at a product line may assemble multiple waterproof sub-units into a complete waterproof unit to install on the conical body. However, the designer may divide the complete unit into several sub-units of any shapes and design a corresponding assembling process, which is not limited to the embodiment shown in FIG. 7, any waterproof part that has double layers as two incident interfaces are one of embodiments of the present invention.

In addition, the designer may dispose the waterproof unit on any location to cover on the corrugations CRG1, CRG2 or CRG3, which adjusts the distance between two or more waterproof units. Moreover, in addition to the locations where the waterproof unit is disposed on the conical body of the feedhorn, a material of the waterproof unit and a shape and a material of the conical body can be adjusted according to practical requirements.

To sum up, the feedhorn of the present invention is equipped with two of the waterproof units (i.e. the double-layered waterproof part), such that the reflected waves of the waterproof units are substantially out-of-phase to substantially cancel the reflected waves. Under the condition that the shape and material of the conical body are fixed, the return loss and the useful bandwidth of the feedhorn may be improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A waterproof part, for a feedhorn, comprising:

a first waterproof unit having a first interface for generating a first reflected wave and a first transmitted wave when a satellite signal incidents the first interface; and a second waterproof unit covering on the first waterproof unit and having a second interface for generating a second reflected wave and a second transmitted wave when the first transmitted wave incidents the second interface;

wherein the first and second reflected waves are substantially out-of-phase to substantially cancel the first and second reflected waves.

2. The waterproof part of claim 1, wherein a distance between the first interface and the second interface is substantially a quarter wavelength of a central frequency of the satellite signal, such that the first reflected wave and the second reflected wave are substantially out-of-phase.

3. The waterproof part of claim 1, wherein the feedhorn comprises a conical body on which a plurality of corrugations is formed.

4. The waterproof part of claim 3, wherein the first waterproof unit comprises:

a first plate comprising:

the first interface extending along a first direction and located between the conical body and the first plate, wherein the first interface is an incident interface that the satellite signal encounters before entering the first plate and passing through the conical body; and a third interface extending along the first direction, wherein the third interface is a transmitted interface that the satellite signal encounters after passing through the first plate; and a first sidewall coupled to the first plate, extending along a second direction, surrounding a first corrugation of the plurality of corrugations, such that the first corrugation is covered with the first waterproof unit;

wherein, the first direction is perpendicular to the second direction.

5. The waterproof part of claim 4, wherein the first plate further comprises a first sub-plate, a second sub-plate and a bonding interface, wherein the first and second sub-plates are bonded at the bonding interface to assemble into the first plate.

6. The waterproof part of claim 5, wherein the first sidewall further comprises a first sub-sidewall, a second sub-sidewall and the bonding interface, wherein the first and second sub-sidewall are bonded at the bonding interface to assemble into the first sidewall.

7. The waterproof part of claim 3, wherein the second waterproof unit comprises:

a second plate comprising:

the second interface extending along a first direction and located between the third interface and the second plate, wherein the second interface is an incident interface that the first transmitted wave encounters before entering the second plate and after passing through the first waterproof unit; and a fourth interface extending along the first direction, wherein the fourth interface is a transmitted interface that the first transmitted wave encounters after passing through the second plate; and a second sidewall coupled to the second plate extending along a second direction, surrounding a second corrugation of the plurality of corrugations or the first sidewall, such that the second corrugation or the first waterproof unit is covered with the second waterproof unit;

wherein, the first direction is perpendicular to the second direction.

8. The waterproof part of claim 7, wherein the second plate further comprises a first sub-plate, a second sub-plate and a bonding interface, wherein the first and second sub-plates are bonded at the bonding interface to assemble into the second plate.

9. The waterproof part of claim 8, wherein the second sidewall further comprises a first sub-sidewall, a second sub-sidewall and the bonding interface, wherein the first and second sub-sidewalls are bonded at the bonding interface to assemble into the second sidewall.

10. The waterproof part of claim 1, further comprising a bonding unit for bonding the first and second waterproof units.

* * * * *